United States Patent [19]

Sacks

[11] Patent Number: 4,860,822

[45] **Date of Patent: * Aug. 29, 1989**

[54] LANCED SINE-WAVE HEAT EXCHANGER

[75] Inventor: Paul S. Sacks, Cazenovia, N.Y.

[73] Assignee: Carrier Corporation, Syracuse, N.Y.

[ * ] Notice: The portion of the term of this patent subsequent to Nov. 29, 2005 has been disclaimed.

[21] Appl. No.: 127,837

[22] Filed: Dec. 2, 1987

[51] Int. Cl.[4] ..... F28F 1/24; F28D 1/04

[52] U.S. Cl. ..... 165/151; 165/181; 165/182

[58] Field of Search ..... 165/151, 181, 182

[56] References Cited

U.S. PATENT DOCUMENTS

| | | | |
|---|---|---|---|
| 3,645,330 | 2/1972 | Albright et al. | 165/151 |
| 4,300,629 | 11/1981 | Hatada et al. | 165/151 |
| 4,365,667 | 12/1982 | Hatada et al. | 165/181 X |
| 4,434,844 | 3/1984 | Sakitani et al. | 165/151 |
| 4,691,768 | 9/1987 | Obosu | 165/151 |
| 4,723,599 | 2/1988 | Hanson | 165/151 |
| 4,787,442 | 11/1988 | Esformes | 165/181 X |

FOREIGN PATENT DOCUMENTS

| | | | |
|---|---|---|---|
| 274438 | 5/1914 | Fed. Rep. of Germany | 165/151 |
| 3131737 | 4/1982 | Fed. Rep. of Germany | 165/151 |
| 0003508 | 1/1980 | Japan | 165/181 |
| 0185992 | 10/1984 | Japan | 165/151 |
| 0223995 | 11/1985 | Japan | 165/151 |
| 0268987 | 11/1986 | Japan | 165/151 |
| 389277 | 10/1973 | U.S.S.R. | 165/151 |

*Primary Examiner*—Robert E. Garrett
*Assistant Examiner*—Carl D. Price
*Attorney, Agent, or Firm*—Robert H. Kelly

[57] ABSTRACT

A sine-wave like plate fin for a finned tube heat exchanger coil is provided having an improved enhanced heat transfer area between adjacent pairs of holes in the plate fin. The enhanced heat transfer area includes a plurality of raised lance elements disposed thereon generally at the peaks and troughs of the sine-wave wherein the raised elements at the peaks are concave and the raise elements at the troughs are convex.

8 Claims, 2 Drawing Sheets

LANCED SINE-WAVE HEAT EXCHANGER

BACKGROUND OF THE INVENTION

The present invention relates generally to heat exchange coils, and more particularly to a finned tube heat exchanger coil having plate fins including a lanced sine-wave heat transfer surface for use in heating, ventilation, and air-conditioning and a method for manufacturing thereof.

Plate fins utilized in the air conditioning and refrigeration industry are normally manufactured by progressively stamping a coil of plate fin stock and then cutting the stamped fin to the desired length. The fins are then collected in the proper orientation and number in preparation for forming a coil. Previously formed hairpin tubes are then inserted through openings within the fins and thereafter expanded to form a mechanical and thermal connection between the tubes and fins. The open ends of the hairpin tubes are fluidly connected by way of U-shaped return bends, and subsequently the return bends are soldered or brazed in place. The plate fins are typically manufactured in either a draw or drawless die to form both the fin shape as well as surface variations on the fin and openings through which the tubular members are inserted.

Generally, the HVAC industry presently forms a plurality of rows of fins simultaneously from a section of plate fin stock. These rows of fins are cut to the desired number of rows for the coils and are then collected on stacking rods or within a box or some other means to form a pile or stack of fins ready to be laced with hairpin tubes to form the coil.

Prior art fins are provided with a variety of surface variations or enhancements to improve the transfer of heat energy between the fluids passing through the tubular members and over the plate fin surfaces. These enhanced fins are either flat fins or wavy fins. Flat fins are generally enhanced by manufacturing raised lances therein. A raised lance is defined as an elongated portion of fin formed by two parallel slits whereby the stock between the parallel slits is raised from the surface of the fins stock. Wavy fins, in addition to having raised lances, may also have louvered enhancements. A louver is defined a section of fin stock having one elongated slit wherein the surface of the fin stock on one side of the slit is raised from the surface of the stock.

Generally, enhanced wavy fins either have a raised lance or a louver at both the leading and trailing edges. Enhanced fins with raised lances at the edges are weak and non-rigid along the edges due to the surface enhancement thereon. Enhanced wavy fins with louvers at the leading and trailing edges have very steeply inclined surfaces at the edges and cause excessive pressure drop due to the steep angle of inclination.

Thus, there is a clear need for an enhanced plate fin surface which has strong leading and trailing edges, and also eliminates the very deep trough which contributes to excessive pressure drop.

SUMMARY OF THE INVENTION

It is an object of the present invention to provide an improved enhanced fin in a plate fin heat exchanger coil.

It is another object of the present invention to provide an enhanced plate fin having a basic sine-wave pattern with raised lances at the maximums and minimums of the sine-wave adjacent the tubes in a multirow fin coil.

It is yet another object of the present invention to improve the strength and rigidity of the leading and trailing edges of single row fin coils.

It is a further object of the present invention to provide a multirow fin coil with an enhanced plate fin having the trough between tubes of a basic sine-wave pattern to reduce pressure drop through the heat exchanger coil.

It is yet a further object of the present invention to provide a multirow enhanced plate fin which may be cut into single-row fins for use in heat exchanger coils.

These and other objects of the present invention are obtained by means of an enhanced plate fin having a basic sine-wave pattern with raised lances at each peak and trough of the sine-wave pattern adjacent to the rows of tubes, but being free from enhancements at the trough between rows of tubes.

The various other features of novelity which characterize the invention are pointed out with particularly in the claims annex to and forming a part of this specification. For a better understanding of the invention, its operating advantages and specific objects obtained by its use, reference should be had to the accompanying drawings and descriptive matter in which there is an illustrated and described preferred embodiment of the invention.

BRIEF DESCRIPTION OF THE DRAWINGS

Other objects and advantages of the present invention will be apparent from the following detailed description in conjunction with the accompanied drawings, forming a part of this specification, and in which reference numerals shown in the drawings designate like or corresponding parts throughout the same, and in which.

DESCRIPTION OF THE PREFERRED EMBODIMENT

Figure 1:
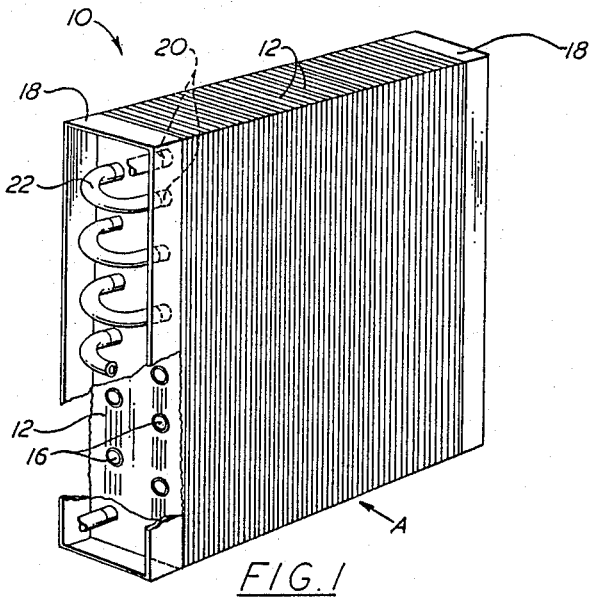
FIG. 1 is a perspective view of a plate fin heat exchanger incorporating the enhanced plate fin of the present invention.

Referring to FIG. 1, there is illustrated a plate finned tube heat exchanger coil 10 incorporating a preferred embodiment of the present invention. Heat exchanger coil 10 comprises a plurality of spaced-apart fin plates 12, wherein each plate fin 12 has a plurality of holes 16 therein. Fin plates 12 are maintained together by oppositely disposed tube sheets 18 having holes therethrough in axially alignment with holes 16. A plurality of hairpin tubes 20 are laced through select pairs of holes 16 as illustrated and have their open ends joined together in fluid communication by return bins 22, which are secured to the hairpin tubes 20 by soldering or brazing or the like.

In operation, a first fluid to be cooled or heated flows through hairpin tubes 20 and a cooling or heating fluid is then passed between fin sheets 12 and over tubes 20 in a direction indicated by arrow A. Heat energy is transferred from or to the first fluid through hairpin tubes 20 and plate fins 14 to or from the other fluid. The fluids may be different types, for example, the fluid flowing through tubes 20 can be a refrigerant and the fluid flowing between plate fins 14 and over the tubes 20 can be air.

As illustrated in FIG. 1, plate fin tube heat exchanger coil 10 is a staggered two-row coil since each plate fin 14 has two rows of staggered holes therein for receiving hairpin tubes. The present invention contemplates a heat exchanger coil of only one row of tubes, or more than two rows of tubes, and with holes 16 of one row in staggered relation with holes 16 of an adjacent row. Also, multirow coils can be formed either from a plurality of multirow single plate fins or a composite of a plurality of single row coils.

Figure 2:
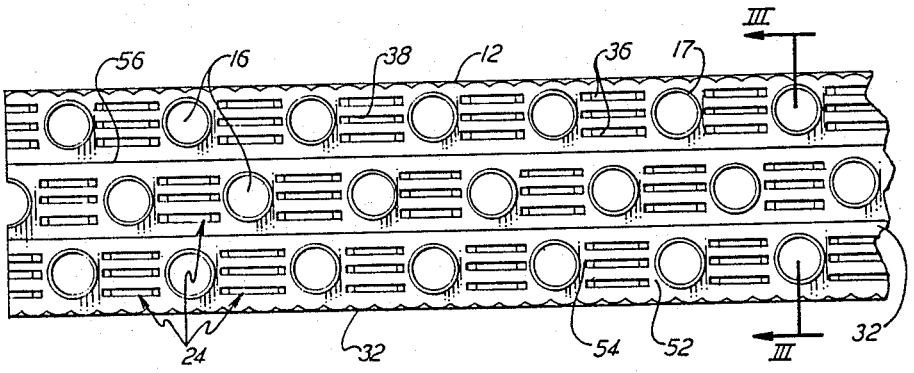
FIG. 2 is a top plan view of a preferred embodiment of the present invention.
Figure 3:
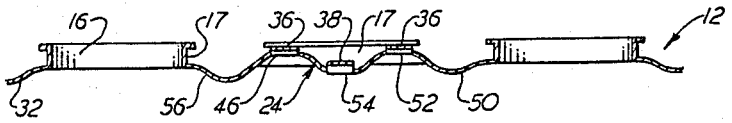
FIG. 3 is a sectional view taken along line iii—iii of FIG. 2.

Referring now to FIGS. 2–3, another embodiment of the present invention is illustrated wherein plate fin 12 is a staggered three-row fin type having three rows of staggered holes 16 with enhanced heat transfer sections 24 disposed between adjacent holes 16. Collars 17 are formed about holes 16 during fin manufacture for receiving tubes 20 therein to insure good physical and thermal contact. The plate fins generally have two complete sine-like wave patterns per row of tubes.

Referring primarily to FIG. 3, the cross-section of plate fin 12 taken in a plane generally transverse to fin 12 illustrates a double wavy sine-like wave pattern along the surface line 50 of the fin 12. Generally elongate lanced elements 36, 38 are raised upwardly relative to the original surface along surface line 50. Lanced elements 36, 38 also maintain an original convex or concave shape, respectively, in the plane of the cross-section. Further, the raised lanced elements 36, 38 are positioned only at the maximums and minimums, or peaks and troughs respectively, of the sine-like wave patterns. Further, the raised lance elements 36, 38 occur only just oppose the tube hole 16. Thus, the trough 56 between adjacent tube rows has no raised lances therein. The absence of raised lances in trough 56 allows for slitting a multirow fin into single row fins whereby the leading and trailing edges do not contain a portion of a raised lance. Thus, in single row fins, as will be fully described herein, the leading and trailing edges are not fragile and subject to deformation. In summary, FIGS. 2 and 3 illustrate an embodiment of the present invention having a double wavy pattern per tube row, and accordingly there are three raised lances per double wavy pattern. Generally elongate raised lance elements 36, 38 are parallel to edges 32 of plate fin 14 and are positioned between adjacent holes 16 in each tube row. Further, elongate raised lance elements 36, 38 are cut or lanced on both sides thereof to define a pair of oppositely disposed openings 46 with the openings on opposite sides of the peaks and troughs. It should also be noticed relative to the raised lance elements 36, 38 that they are generally concave in the troughs between adjacent tubes, and convex at the peaks between adjacent tubes, but there are no raised lance elements in the troughs between adjacent rows of tubes. Thus, the cross-sectional shapes of elements 36, 38 are curved and generally either convex or concave depending on the original wave line 50.

As described above, raised lanced elements 36, 38 increase the ability of plate fin 12 to absorb or dissipate heat as required.

Figure 4:
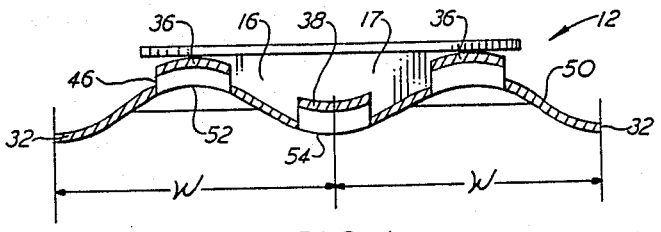
FIG. 4 is an elevational view of a single-row plate fin incorporating a preferred embodiment of the present invention.

Referring now to FIG. 4, there is illustrated a cross-sectional elevational view of a single row plate fin 12 of another preferred embodiment of the present invention. The single row plate fin 12 is generally cut from a multiple row plate fin sheet, but may be individually manufactured as a single row plate fin. The fin 12 illustrates a double wavy sine-like wave pattern along the surface of line 50 wherein each sine-wave has a length (W). Thus, each single row plate fin 12 has raised lanced elements 36, 38 at each peak 52 and trough 54 between adjacent tube holes 16. It should be noted that raised lanced elements 36, 38 are vertically offset from the surfaced line 50 only in the plane between adjacent tube holes 16. Thus, the edges 32 of plate fin 12, even though they are at a minimum or trough of the wave line 50, are free from raised lanced elements. The absence of raised lanced elements at the edges of the plate fins provide rigidity to the plate fins and prevent a ragged or cluttered appearance due to the shredding or twisting of lanced elements at the edges. Moreover, non-enhanced edges 32 eliminate problems caused by steeply inclined surfaces when the edges have raised louvers or damaged fins when the edges have raised lances or portions of raised lances.

Further, because of the double wavy sine-like pattern formed by raised elements 36, 38 along surface line 50, the pressure drop across fins 12 is minimized, which further increases the heat transfer efficiency thereof.

Figure 5:
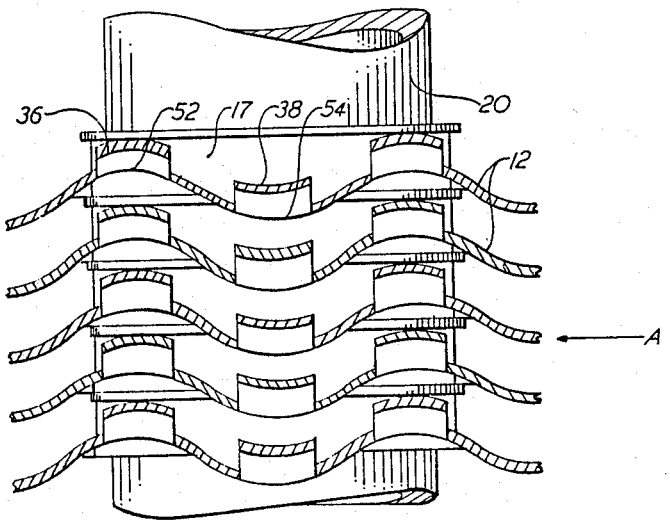
FIG. 5 is a fragmentary elevational view of a single-row coil incorporating a plurality of the preferred embodiments of the present invention.

Referring now to FIG. 5, there is illustrated a transverse cross-sectional elevational view of a plurality of spaced-apart fins 12 with a tube received through respective axially aligned holes 16. Collars 17 are formed about holes 16 during fin manufacture for receiving tubes 20 therein and for properly spacing adjacent plate fins. Arrow A indicates the direction of fluid flow, such as air flow, over and between plate fins 12 and around tube 20. As the fluid flows between fins 12, raised lanced elements 36, 38 cause the fluid to follow a tortuous path to either absorb or dissipate heat energy with fins 12. A tortuous path followed by the fluid through plate fins 12 virtually eliminates a continuing buildup of boundary layer stagnation along the surface of fins 12. Boundary layer buildup is particularly undesirable since boundary layers on heat transfer surfaces decrease the rate of heat transfer, and if the boundary layer is not disrupted, it gradually increases in depth along its length, which further degrades heat transfer. Also, the positioning of the raised lanced elements 36, 38 only at the peaks 52 and through 54 of surface line 50 minimizes the pressure drop across plate fins 12, which further increases the heat transfer efficiency thereof.

Plate fins 12 and tubes 20 can be made of aluminum, cooper, or other suitable materials.

While preferred embodiments of the present invention have been depicted and described, it will be appreciated by those skilled in the art that many modifications, substitutions, and changes may be made thereto without departing from the true spirit and scope of the invention.

What is claimed is:

1. A heat transfer plate fin including opposite facing first and second surfaces for transferring heat between the first and second surfaces and a fluid flowing over the surfaces comprising:

a convoluted heat transfer means for enhancing the exchange of heat between the fluid flowing over the surfaces, said convoluted heat transfer means having a sine-like wave pattern of predetermined height along the first and second surfaces in a direction parallel to the flow of the fluid flowing over the surfaces, said sine-like wave pattern having curved peaks at a maximum of said wave heights of the pattern and curved troughs at a minimum of said wave heights of the pattern whereby said peaks and troughs extend along said convoluted heat transfer means generally transverse to the direction of flow of fluid flowing over the surfaces;

a plurality of enhanced heat transfer sections disposed generally along a selected number of said peaks and troughs, said enhanced heat transfer sections having a group of generally elongate raised lance elements only at said curved peaks and said curved troughs, and a leading edge section and trailing edge section upstream and downstream of the direction of flow of fluid flowing over the surfaces of each of said enhanced heat transfer sections respectively, said leading and trailing sections being free from raised lance elements.

2. A plate fin as set forth in claim 1 wherein said raised lance elements are raised with respect to the first surface.

3. A plate fin as set forth in claim 2 wherein said each sine-like pattern is a double wavy pattern having two peaks each with a raised lance elements and one trough with a raised lance element.

4. A plate fin as set forth in claim 2 wherein said raised lance elements at the peaks have a concave cross-sectional shape and said raised lance elements at the troughs have a convex cross-sectional shape.

5. An enhanced plate fin tube heat exchanger comprising:

a plurality of heat conductive convoluted plate fins having a plurality of holes therein, said fins having oppositely facing first and second surfaces, said fins disposed parallel to each other at predetermined intervals whereby a first fluid flows over said surfaces between adjacent fins;

a plurality of heat transfer tubes disposed in respective ones of said holes in heat transfer relation with said plate fins, said heat transfer tubes adapted to having a second fluid flowing therethrough whereby heat is transferred between said first and second fluids;

each of said convoluted plate fins having a sine-wave like shape in a plane generally parallel to the flow of said first fluid, said sine-wave like shaped convoluted plate fin having a predetermined peak to trough amplitude with curvilinear peaks at a maximum of the amplitude and curvilinear troughs at a minimum of the amplitude; and each of said convoluted plate fins having an enhanced heat transfer portion disposed between adjacent said holes, said enhanced heat transfer portion having a group of generally elongate raised lance elements only at said curvilinear peaks and troughs, each of said enhanced heat transfer portion having a leading edge section upstream in the direction of the first fluid and a trailing edge section downstream in the direction of the first fluid, whereby said leading and trailing edge portions are free from raised lance elements and whereby a surface between adjacent raised lance elements is maintained at a plane of the first and second surface.

6. An enhanced plate fin tube heat exchanger as set forth in claim 5 wherein said raised lance elements are raised with respect to the first surface.

7. An enhanced plate fin tube heat exchanger as set forth in claim 6 wherein each sine-wave like fin has a double wavy pattern having two peaks each with one raised lance element and one trough with a raised lance element.

8. An enhanced plate fin tube heat exchanger as set forth in claim 6 wherein said raised lance elements at the peaks have a concave cross-sectional shape and said raised lance elements at the troughs have a convex cross-sectional shape.

* * * * *